US011439201B2

(12) United States Patent
Hatfield

(10) Patent No.: US 11,439,201 B2
(45) Date of Patent: Sep. 13, 2022

(54) PAIR OF ASYMMETRICAL FOOTWEAR ARTICLES

(71) Applicant: NIKE, Inc., Beaverton, OR (US)

(72) Inventor: Tobie D. Hatfield, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 275 days.

(21) Appl. No.: 16/059,811

(22) Filed: Aug. 9, 2018

(65) Prior Publication Data

US 2019/0045886 A1 Feb. 14, 2019

Related U.S. Application Data

(60) Provisional application No. 62/543,805, filed on Aug. 10, 2017.

(51) Int. Cl.
*A43C 11/14* (2006.01)
*A43B 3/00* (2022.01)
(Continued)

(52) U.S. Cl.
CPC ..... *A43C 11/1493* (2013.01); *A43B 3/0036* (2013.01); *A43B 3/0094* (2013.01);
(Continued)

(58) Field of Classification Search
CPC ... A43B 23/027; A43B 23/088; A43B 3/0036; A43B 3/0094; A43B 5/06; A43B 5/008;
(Continued)

(56) References Cited

U.S. PATENT DOCUMENTS 2,088,851 A 8/1937 Gantenbein
2,326,776 A * 8/1943 Gellman ..... A43B 5/02 36/99
(Continued)

FOREIGN PATENT DOCUMENTS

DE 20004064 U1 * 6/2000 ..... A43B 1/0054
DE 20312946 U1 2/2004
(Continued)

OTHER PUBLICATIONS

"Five Ten® Autumn 2011," Outdoor Retailer SLC, lyramag.blogspot.com May 28, 2011. http://lyramag.blogspot.com/2011/05/five-ten-autumn-fall-2011 html.
(Continued)

*Primary Examiner* — Sharon M Prange
*Assistant Examiner* — Grace Huang
(74) *Attorney, Agent, or Firm* — Shook Hardy & Bacon LLP

(57) ABSTRACT

A pair of shoes may be asymmetric between one another in various respects. For example, the left shoe may include a left-shoe wrapping panel non-releasably coupled to a left-shoe medial side and extending towards a left-shoe lateral side while the right shoe may include a wrapping panel non-releasably coupled to a right-shoe lateral side and extending towards a right-shoe medial side. The left-shoe wrapping panel may releasably couple to the left-shoe lateral side and the right-shoe wrapping panel may releasably couple to the right-shoe medial side. The left shoe and the right shoe may respectively include a left-shoe heel strap and a right-shoe heel strap. The left-shoe heel strap and a right-shoe heel strap each respectively wrap around, at least in part, a heel region of the left shoe and the right shoe.

19 Claims, 6 Drawing Sheets

(51) Int. Cl.
*A43B 23/02* (2006.01)
*A43B 5/06* (2022.01)
*A43C 15/16* (2006.01)

(52) U.S. Cl.
CPC ..... *A43B 5/06* (2013.01); *A43B 23/027* (2013.01); *A43C 15/16* (2013.01)

(58) Field of Classification Search
CPC .. A43B 5/02; A43B 5/10; A43B 5/001; A43B 5/0411; A43B 5/14; A43B 5/145; A43C 15/16; A43C 11/1493
USPC ..... 36/114, 115, 116, 129, 105
See application file for complete search history.

(56) References Cited

U.S. PATENT DOCUMENTS 3,408,752 A * 11/1968 Paul ..... A43C 11/008 36/105
4,010,558 A * 3/1977 Slusher ..... A43B 1/10 36/7.3
4,317,296 A * 3/1982 Hanson ..... A43B 5/0409 36/105
4,486,965 A * 12/1984 Friton ..... A43C 11/1493 36/50.1
4,517,753 A 5/1985 Rosenbaum et al.
4,616,432 A 10/1986 Bunch et al.
4,642,914 A * 2/1987 Caldeira ..... A43C 11/1493 36/114
4,876,806 A 10/1989 Robinson et al.
6,270,468 B1 8/2001 Townsend et al.
6,286,233 B1 * 9/2001 Gaither ..... A43C 1/00 36/50.1
6,745,500 B2 * 6/2004 Suzuki ..... A43B 11/00 36/50.1
7,543,397 B2 6/2009 Kilgore et al.
7,823,301 B2 11/2010 Belluto
8,302,329 B2 * 11/2012 Hurd ..... A43B 23/08 36/89
8,516,721 B2 * 8/2013 Mahoney ..... A43B 7/1425 36/102
8,763,279 B2 * 7/2014 Torrance ..... A43B 5/14 36/131
8,857,077 B2 * 10/2014 Kahatsu ..... A43B 3/26 36/50.1
8,869,435 B2 10/2014 Hatfield et al.
8,881,429 B2 11/2014 Schwartz
10,758,010 B2 * 9/2020 Drake ..... A43C 11/1493
2001/0042323 A1 * 11/2001 Fusco ..... A43B 3/0094 36/114
2010/0313445 A1 * 12/2010 Hochdoerffer ..... A43B 1/0027 36/50.1
2011/0185595 A1 * 8/2011 Berth ..... A43B 5/0486 36/117.2
2014/0101824 A1 * 4/2014 Spanks ..... A61F 13/08 2/239
2014/0130376 A1 5/2014 Fahmi et al.
2014/0352170 A1 12/2014 Heathcote
2017/0119088 A1 * 5/2017 Regan ..... A43B 3/0031
2017/0238645 A1 * 8/2017 Ahn ..... A43B 1/0081
2018/0242692 A1 * 8/2018 Houng ..... A43C 11/14
2018/0289100 A1 * 10/2018 Bell ..... A43B 11/00
2018/0303191 A1 * 10/2018 Poremba ..... A43B 3/122
2021/0361032 A1 * 11/2021 Maselino ..... A43B 7/1495
2022/0007792 A1 * 1/2022 Bidal ..... A43C 1/06

FOREIGN PATENT DOCUMENTS

DE 10000472 B4 3/2005
EP 2974613 A1 1/2016
FR 2930872 A1 * 11/2009 ..... A43C 11/14
JP 5696958 B2 4/2015
KR 20080039249 A * 5/2008 ..... A43C 11/1493

OTHER PUBLICATIONS

"Scott Road Team Boa Shoe," Scott, scott-sports.com, accessed: Aug. 2016. http://www.scott-sports.com/nz/en/products/238874/SCOTT-Road-Team-Boa-Shoe/.
Dengate, Jeff, "Hoka One One Debuts New Track Spike," Runner's World, runnersworld.com, Jun. 30, 2016. http://www.runnersworld.com/gear-check/hoka-one-one-debuts-new-track-spike.
Pruett, Parker, "Puma/Bolt Concepts," Coroflot, coroflot.com, Apr. 24, 2011. http://www.coroflot.com/ppruett/pumabolt-concepts.
"Shimano Women's SH-WM53 Mtb Shoes—Performance Exclusive," Performance® Bicycle, performancebike.com, Item #11-3674, accessed: Aug. 2016 http://www.performancebike.com/bikes/Product_10052_10551_1196470_-1_.

* cited by examiner

PAIR OF ASYMMETRICAL FOOTWEAR ARTICLES

CROSS-REFERENCE TO RELATED APPLICATION

This application entitled "Pair of Asymmetrical Footwear Articles," claims the benefit of priority of U.S. Provisional Application No. 62/543,805, entitled "Pair of Asymmetrical Footwear Articles," and filed Aug. 10, 2017. The entirety of the aforementioned application is incorporated by reference herein.

TECHNICAL FIELD

This disclosure is related to a pair of footwear articles having asymmetric features between the pair.

BACKGROUND

In footwear used for running, exercising, and other physical activity, shoes will commonly include a sole and an upper. The sole may include various elements that provide functions, such as protection from a ground surface, traction, impact attenuation, cushion, responsiveness, and the like. The upper wraps around at least a portion of a foot in order to secure the foot to the sole, and may also include various elements for providing warmth, weather resistance (e.g., water, wind, etc.), breathability, support, and the like. Pairs of shoes typically include a left shoe and a right shoe. Each of the left shoe and the right shoe will have a plurality of corresponding features.

BRIEF SUMMARY

At a high level, the present application is generally directed to a pair of shoes having asymmetric features between a left shoe and a right shoe. For instance, the structure of the upper of the left shoe may be different from the structure of the upper or the sole of right shoe. A high-level overview of various aspects of the disclosure is provided here to introduce a selection of concepts that are further described in the detailed-description section below. This summary is not intended to identify key features, or essential features, of the claimed subject matter, nor is it intended to be used as an aid in isolation to determine the scope of the claimed subject matter.

BRIEF DESCRIPTION OF THE DRAWINGS

The subject matter of this disclosure is described in detail herein with reference to the attached drawing figures, which are incorporated herein by reference, wherein.

DETAILED DESCRIPTION

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

At a high level, the present application is generally directed to a pair of shoes having asymmetric features between a left shoe and a right shoe. In other words, the structure of the upper of the left shoe is different from the structure of the upper of right shoe. This is in contrast with some pairs of shoes in which the upper of the right shoe is substantially the same as the upper of the left shoe, albeit mirror images of one another. So in this sense, and in accordance with an aspect of this disclosure, in a pair of shoes the left shoe is not a mirror image of the right shoe.

The variance in respective structures of each shoe may be configured to affect one or more functions of the footwear articles, such as the support or fit provided by the shoe when in use. In some aspects, a panel or support strap that wraps around the exterior surface of a left-shoe upper may have a different configuration than a panel or support strap that wraps around the exterior surface of a right-shoe upper. For example, the left-shoe wrapping panel may be non-releasably coupled to a left-shoe medial side and releasably coupled to another portion of the left shoe (e.g., left-shoe lateral side), while a right-shoe wrapping panel may be non-releasably coupled to a right-shoe lateral side and releasably coupled to another portion of the right shoe (e.g., right-shoe medial side). Among other functions, these features may provide an amount of support on the medial side of the left shoe and an amount of support on the lateral side of the right shoe, the support being conducive to at least some physical activity, such as when a wearer cuts or turns on a curved track (e.g., running track or speed-skating track), which might have banked turns.

Figure 1:
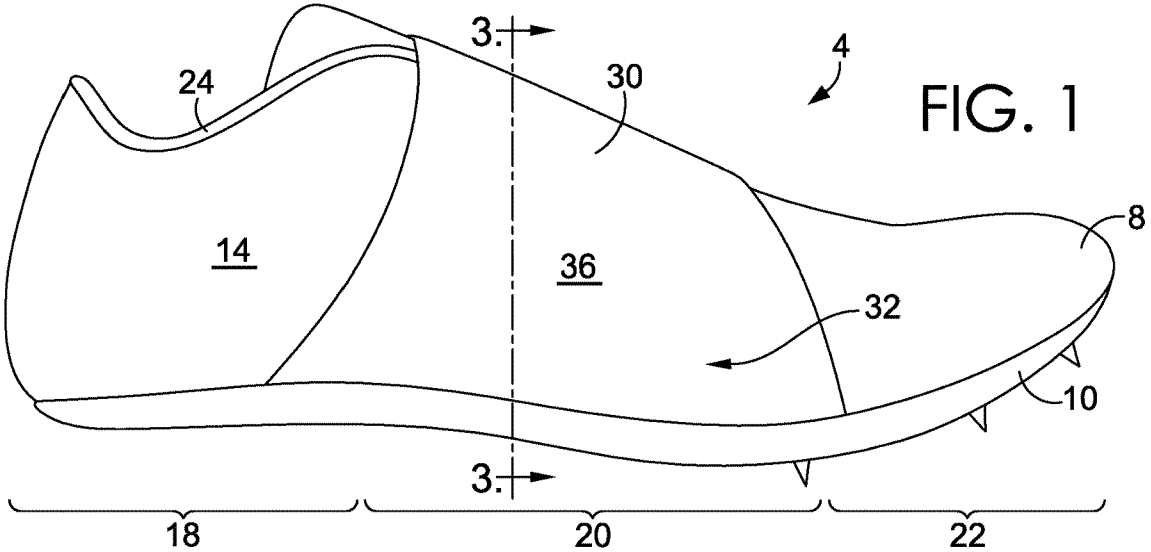
FIG. 1 depicts a side view of a shoe in accordance with an aspect hereof.
Figure 2:
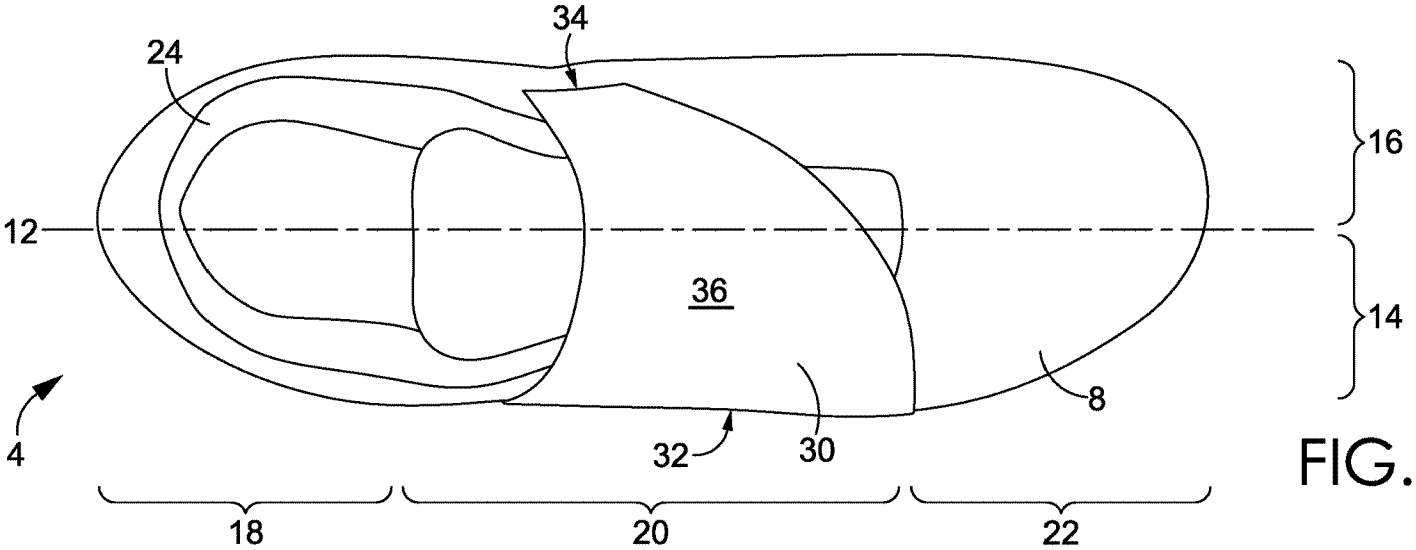
FIG. 2 depicts a top view of the shoe of FIG. 1 in accordance with an aspect hereof.

Referring now to FIGS. 1 and 2, an exemplary footwear article 4 is illustrated to help explain some footwear structures, at least some of which may have a different configuration as between a left shoe and a right shoe. The footwear article 4 is a right shoe and includes a sole 10 and an upper 8. The upper 8 and the sole 10 generally form a foot-receiving space that encloses at least part of a foot when the footwear article 4 is worn or donned. The foot-receiving space is accessible by inserting a foot through an opening formed by an ankle collar 24. The upper 8 generally functions to secure a wearer's foot to the sole 10, and in some instances, is adjustable to loosen or tighten a fit of the footwear article 4. The sole 10 generally functions to protect the bottom of a wearer's foot from a ground surface and may also provide traction, cushioning, responsiveness, and the like.

While the examples of shoe uppers (e.g., upper 8) and shoe bottom units (e.g., sole 10) are presented in a simplified fashion for exemplary purposes herein, in practice a shoe upper may comprise a large number of individual parts, often formed from different types of materials. Alternatively, a shoe upper may be primarily formed from a single manufacturing technique, such as weaving or knitting, to concurrently and integrally form two or more portions of the shoe upper. The components of a shoe upper may be joined together using a variety of adhesives, stitches, and other types of joining and bonding components.

A sole often includes an assembly of multiple components. For example, a sole may comprise an outsole made of a relatively hard and durable material, such as rubber, that contacts the ground, floor, or other surface. A sole may further comprise a midsole formed from a material that provides cushioning and absorbs/attenuates force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Shoe soles may further have additional components, such as additional cushioning components (e.g., springs, air bags, and the like), functional components (e.g., motion control elements to address pronation or supination), protective elements (e.g., resilient plates to prevent damage to the foot from hazards on the floor or ground), and the like. Although the footwear article 4 depicted in the illustrative figures is depicted to include a running shoe or a track spike, in other aspects of this disclosure the features and elements described herein, may be incorporated into other types of footwear.

When describing various aspects of the footwear article 4, relative terms may be used to aid in understanding relative positions. For instance, the footwear article 4, which includes a right shoe, includes a lateral side 14 (FIG. 2), a medial side 16 (FIG. 2), a superior portion, and an inferior portion. In addition, the footwear article 4 may also be divided into three general regions: a heel region 18, a mid-foot region 20, and a forefoot region 22. The forefoot region 22 generally includes portions of the footwear article 4 corresponding with the toes and the joints connecting the metatarsals with the phalanges. The mid-foot region 20 generally includes portions of footwear article 4 corresponding with the arch area of the foot, and the heel region 18 corresponds with rear portions of the foot, including the calcaneus bone. The lateral side and the medial side extend through each of regions 18, 20, and 22 and correspond with opposite sides of footwear article 4. More particularly, the lateral side corresponds with an outside area of the foot (i.e., the surface that faces away from the other foot), and the medial side corresponds with an inside area of the foot (i.e., the surface that faces toward the other foot). For illustrative purposes, FIG. 2 depicts a midline reference plane 12 that extends from the forefoot region 22 to the heel region 18 and that generally bisects the footwear article 4 into the lateral side 14 and the medial side 16. Further, the superior portion and the inferior portion also extend through each of the regions 18, 20, and 22. The superior portion generally corresponds with a top portion that is oriented towards a person's head when the person's feet are positioned flat on the ground and the person is standing upright, whereas the inferior portion generally corresponds with a bottom portion oriented towards the bottom of a person's foot. These regions 18, 20, and 22, medial/lateral sides, and superior/inferior portions are not intended to demarcate precise areas of footwear article 4. They are intended to represent general areas of footwear article 4 to aid in understanding the various descriptions provided in this Specification. In addition, the regions, sides, and portions are provided for explanatory and illustrative purposes and are not meant to require a human being for interpretive purposes.

Figure 3:
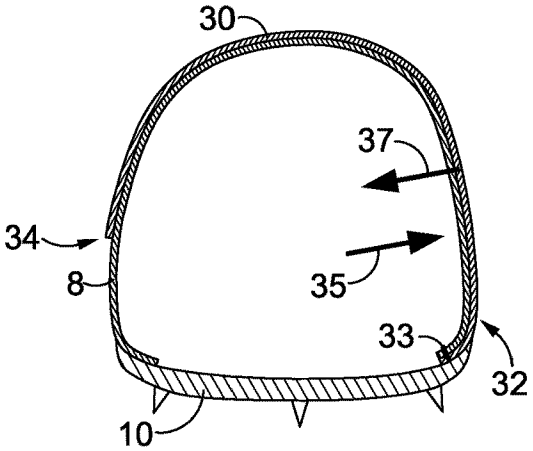
FIG. 3 depicts a cross-section view taken along 3-3 in, and illustrates a portion of the shoe of, FIG. 1 in accordance with an aspect hereof.

With continued reference to FIGS. 1 and 2, and also referencing FIG. 3, a wrapping panel 30 of the footwear article 4 will now be described. The wrapping panel 30 includes a first portion 32 opposite a second portion 34 and a flexible body 36 between the first portion 32 and the second portion 34. The term "wrapping panel" includes any combination of one or more material layers that adjustably wrap around at least a portion of the upper and that function to help secure the upper to the wearer's foot and to provide support against the outside surface of the upper. For example, the wrapping panel may comprise one or more material panels, straps, webbing strips, or cables. In some aspects, the wrapping panel may comprise an elongated material extending from a non-releasable coupling (as defined below).

The first portion 32 of the wrapping panel 30 is non-releasably coupled to the mid-foot region 20 of the upper 8, the sole 10, or both the upper 8 and the sole 10 (e.g., layered between the upper and the sole at the biteline). FIG. 3 schematically depicts at least part of a non-releasable coupling, which is identified by reference numeral 33. As used herein, "non-releasably coupled" means coupling in a manner not operational to repeatedly transition back and forth between a connected state and a disconnected state. For example, a non-releasable coupling may include stitching the first portion 32 to the upper 8, such as when the upper 8 is being constructed and prior to lasting. Other non-releasable couplings may include bonding, welding, adhering, riveting, tacking, integrally knitting, integrally weaving, integrally braiding, melding, thermosetting, and the like. The non-releasable coupling 33 might be any of these couplings, or equivalents thereof. Once the upper has been constructed, including non-releasably attaching the first portion 32 of the wrapping panel, the upper and the first portion of the wrapping panel may be coupled to the sole 10 using another non-releasable coupling.

The second portion 34 of the wrapping panel 30 is releasably coupled to the upper 8. As used herein, "releasably coupled" means coupling in a manner operational to transition back and forth between a connected state and a disconnected state. For example, a releasable coupling may include a hook and loop fastener, a buckle fastener, a snap fastener, and the like. In some aspects, a first part of a hook-and-loop fastener (e.g., loops) are affixed to the upper 8 or are integrally formed with the material of the upper, and a second part of the hook-and-loop fastener (e.g., hooks) are affixed to the second portion 34 of the wrapping panel 30 to permit the wrapping panel 30 to releasably couple to the upper 8.

When the wrapping panel 30 is pulled and non-releasably affixed to the upper 8, the wrapping panel 30 may be held under tension in a manner that provides increased support and improved fit of the footwear article 4 to the wearer. For instance, the wrapping panel 30 may apply a compressive force to the upper 8 (i.e., presses against an outer surface of the upper 8), which provides increased support to, and improved fit of the footwear article 4 around, the wearer's foot. Furthermore, the wrapping panel 30 may provide enhanced support when a wearer is turning or cutting. For example, when a wearer is turning to the left, the wearer's foot may provide a force in the direction of the arrow 35 in FIG. 3. In an aspect of this disclosure, the wrapping panel 30 provides counter-acting support in the opposite direction 37.

FIGS. 1 and 2 depict some additional elements as well. For example, the upper 8 includes a throat, which is partially obscured by the wrapping panel 30, extending from the ankle collar 24 towards the forefoot region 22. As depicted in FIGS. 1 and 2, the upper may be laceless, such that the adjustment of the wrapping panel 30 functions to adjust a fit of the upper 8. That is, as will be explained in additional detail with respect to some of the other figures, the shape and orientation of the wrapping panel may contribute to an adjustable and customizable fit.

And in an alternative aspect, the upper 8 may also include a lacing system (not depicted), which is used in combination with the wrapping panel 30. For example, a series of eyelets may be positioned along opposing edges of the throat, and a tongue may be positioned in the space between the opposing edges. Each eyelet may include an aperture configured to slidably receive a lacing element (e.g., shoe lace, cable, cord, braid, etc.), which is sinuously threaded through consecutively positioned eyelets, back and forth between the throat edges. As such, the lacing element may be configured to tighten a fit of the upper 8 by drawing the throat edges towards one another and to loosen the fit of the upper 8 by releasing a tension applied to the throat edges. For example, when the footwear article 4 is being donned and a tension is applied to the lacing element, the lacing element draws the throat edges towards one another, and in turn draws the lateral side and medial side of the upper 8 against the foot of the wearer to tighten a fit and provide support.

Although the throat edges are illustrated as relatively straight, in other instances, the throat edges may be scalloped, or include some other configuration. In these instances, the eyelets may follow the contour of the throat edge, or alternatively, may be aligned in a relatively straight line extending along the throat edge. Furthermore, the eyelets may be holes or apertures that extend through the upper 8. But in other aspects, the eyelets may have a different configuration, such as a cord loop that is anchored to the upper 8, to the sole 10, or to the upper 8 and the sole 10.

Figure 4A:
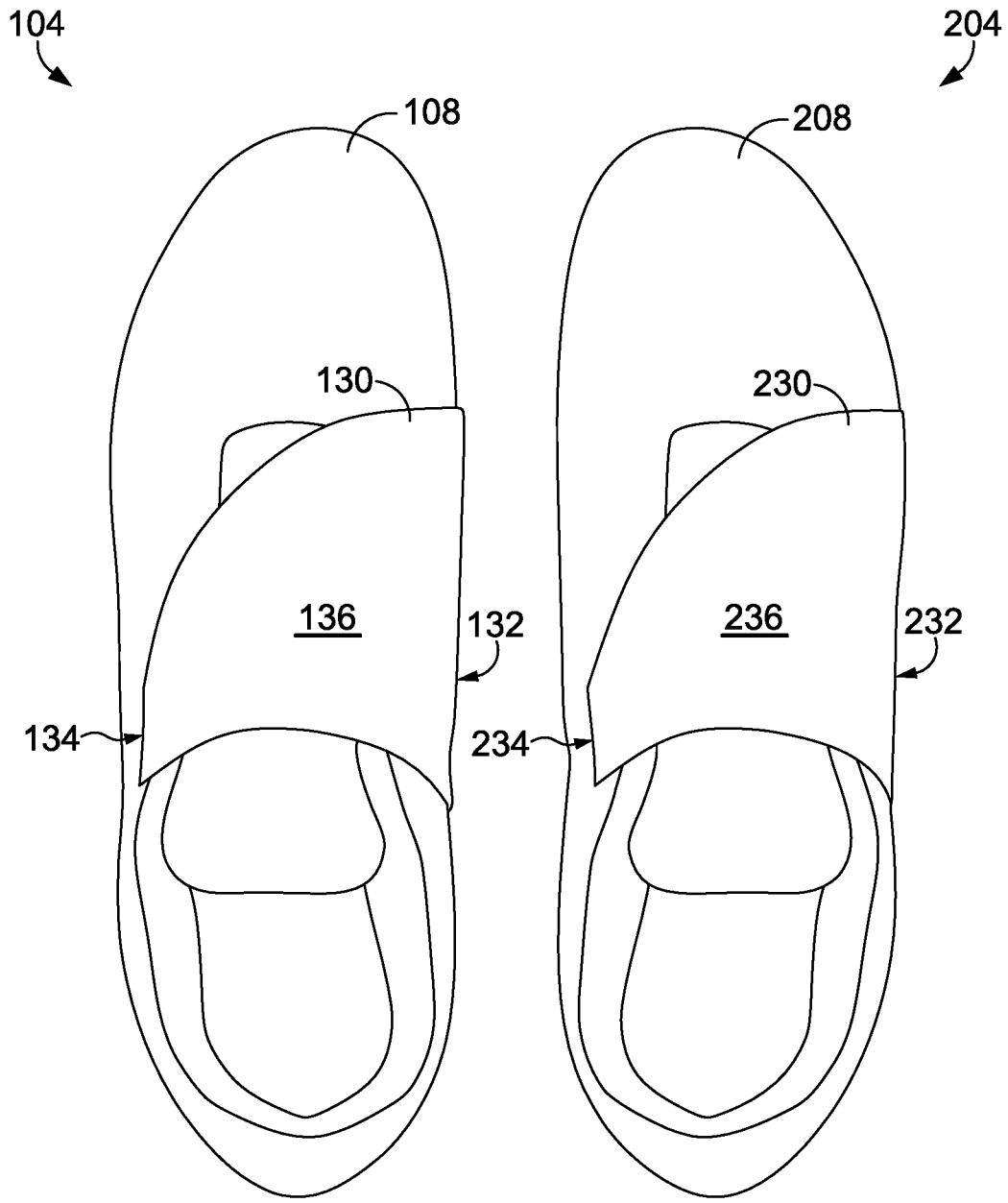
FIG. 4A depicts a top view of a pair of shoes in accordance with an aspect hereof.
Figure 4B:
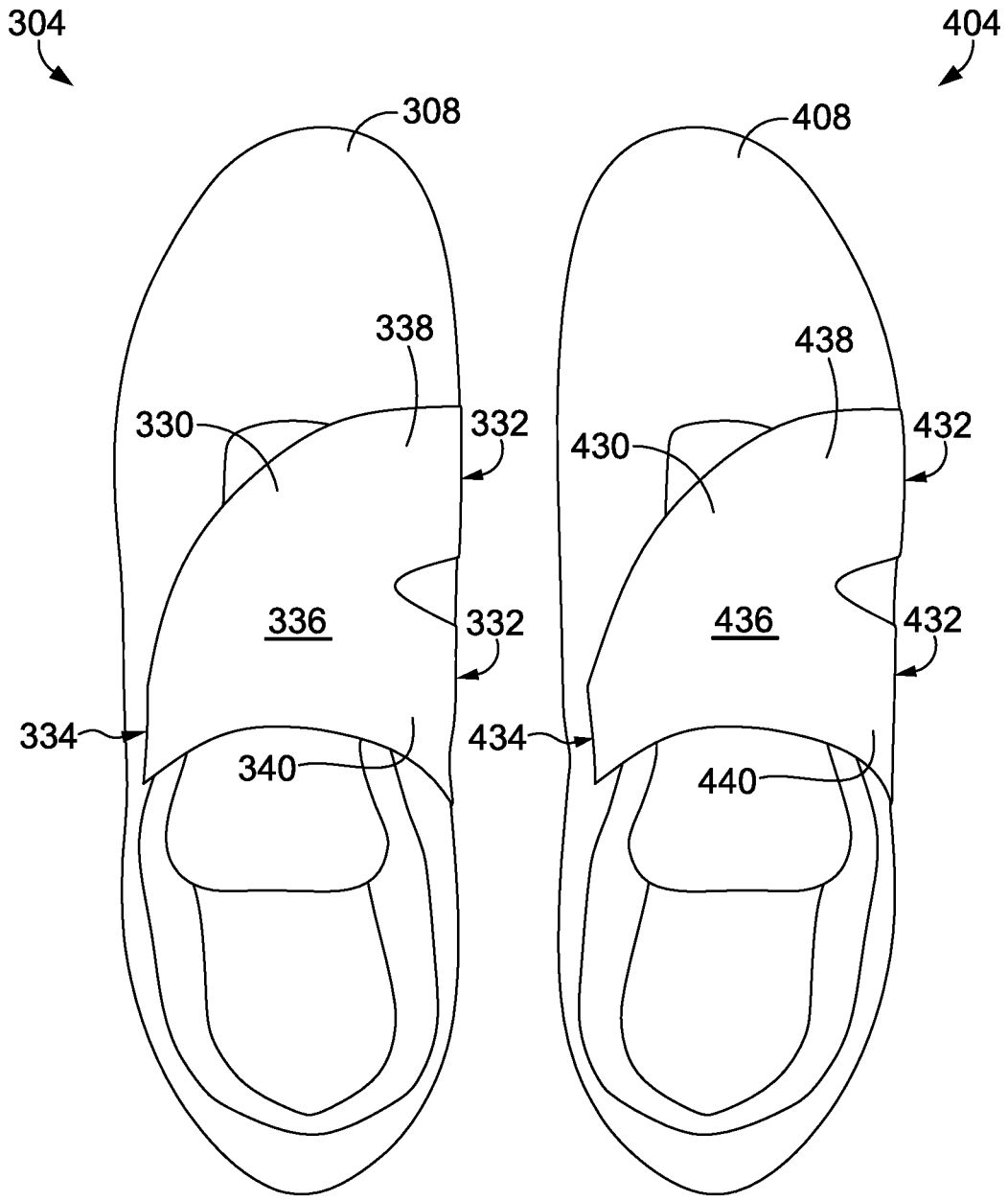
FIG. 4B depicts a top view of another pair of shoes in accordance with an aspect hereof.
Figure 4C:
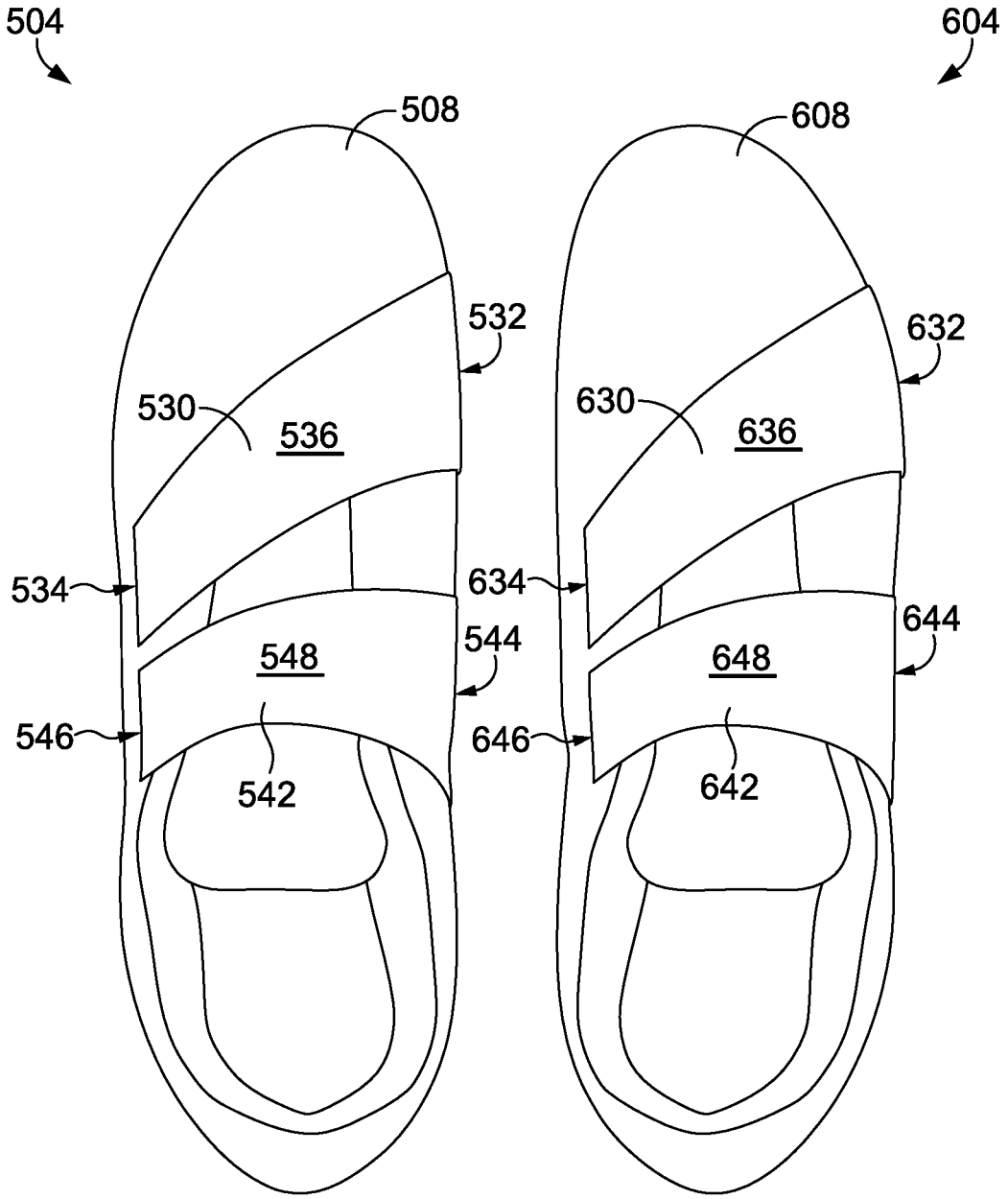
FIG. 4C depicts a top view of yet another pair of shoes in accordance with an aspect hereof.

Having described some elements of an exemplary footwear article 4 that may be asymmetric as between a right shoe and a left shoe, reference is now made to FIGS. 4A, 4B and 4C to describe respective pairs of shoes having asymmetric wrapping panels between a left shoe and a right shoe. Referring initially to FIG. 4A, depicted is a left shoe 104 having a left-shoe upper 108 and a left-shoe wrapping panel 130 non-releasably coupled to a medial side of the left shoe 104 at a first portion 132. Opposite of the first portion 132 is a second portion 134, which may be configured to releasably couple with the left-shoe upper 108. The left-shoe wrapping panel 130 further includes a flexible body 136 extending between the first portion 132 and the second portion 134. Similarly depicted is a right shoe 204 having a right-shoe upper 208 and a right-shoe wrapping panel 230 non-releasably coupled to a lateral side of the right shoe 204 at a third portion 232. Opposite of the third portion 232 is a fourth portion 234, which may be configured to releasably couple with the right-shoe upper 208. The right-shoe wrapping panel 230 further includes a flexible body 236 extending between the third portion 232 and the fourth portion 234.

In FIG. 4A, the second portion 134 is depicted on the lateral side of the left shoe, and the fourth portion 234 is depicted on the medial side of the right shoe. These relative positions may be affected by various factors, such as the length of each wrapping panel, as well as the amount of tension applied to the wrapping panel when being secured to the upper. As such, in other aspects, the second portion 134 and the fourth portion 234 may attach to the respective upper at positions other than those depicted in FIG. 4A. For instance, the second portion 134 and the fourth portion 234 may releasably attach to the upper at a position that is closer to the respective midline of each shoe. And in another aspect, the second portion 134 may releasably attach to the medial side of the left-shoe upper, and the fourth portion 234 may releasably attach to the lateral side of the right-shoe upper. Accordingly, the second portion 134 and the fourth portion 234 may releasably couple to the upper 108 and 208, respectively, at positions on either the lateral side or the medial side of the midline reference plane. In addition, the second portion 134 and the fourth portion 234 may releasably couple to the upper 108 and 208, respectively, at positions associated with the top of the wearer's foot (i.e., the superior portion) of the left shoe 104 and right shoe 204, respectively.

In FIG. 4A, the second portion 134 is depicted at a particular location relative to the forefoot, midfoot, and heel portion of the left shoe 104, and the fourth portion 234 is depicted at a particular location relative to the forefoot, midfoot, and heel portion of the right shoe 204. And in other aspects, the second portion 134 and the fourth portion 234 may attach to the respective upper at positions other than those depicted in FIG. 4A. For instance, the second portion 134 and the fourth portion 234 may releasably couple to the upper 108 and 208, respectively, at positions in the forefoot region, the midfoot region, the heel region, or any combination thereof.

In the illustrated aspect, a width of the first portion 132 is greater than a width of the second portion 134 and a width of the third portion 232 is greater than a width of the fourth portion 234. In other words, the width of the wrapping panels tapers from the non-releasably coupled portion to the releasably coupled portion. In other aspects, the wrapping panels 130 and 230 may widen from the non-releasably coupled portion to the releasably coupled portion. In still other aspects, the wrapping panels 130 and 230 may have a constant width.

In the illustrated aspect, the first portion 132 is non-releasably coupled to the left shoe 104 at the left-shoe midfoot region. In other aspects, the first portion 132 may be non-releasably coupled at one or more of the forefoot region, the midfoot region and the heel region. For example, at least part of the first portion 132 may be non-releasably coupled in the forefoot region, and at least part of the first portion 132 may be non-releasably coupled in the midfoot region. Similarly, the third portion 232 may be non-releasably coupled at one or more of the forefoot region, the midfoot region and the heel region of the right shoe 204.

The width of the left-shoe wrapping panel 130 between the first portion 132 and the second portion 134 (i.e., the width of the flexible body 136) and the width of the right-shoe wrapping panel 230 between the third portion 232 and the fourth portion 234 (i.e., the width of the flexible body 236) determines the amount of the upper (i.e., 108 or 208) on which the wrapping panel (i.e., 130 or 230) is pressing when tension is applied to the wrapping panel (i.e., when the second portion 134 and/or the fourth portion 234 are releasably coupled). In some aspects, the width of the flexible body 136 may be measured in a direction of extension of the wrapping panel 130 from the first portion 132 to the second portion 134. In other aspects, the width of the flexible body 136 may be measured in a direction normal to the direction of extension. Returning to the discussion of the forces applied by the wrapping panels to the shoe uppers, releasably coupling the second portion 134 of the left-shoe wrapping panel 130 would apply tension to the left-shoe wrapping panel 130, which in turn would press against an outer surface of the left-shoe upper 108.

The dimensions and configurations of the wrapping panels may affect how a load applied to the wrapping panels by the wearer's feet is distributed through the wrapping panels. Similarly, the dimensions of the wrapping panels may affect how a load applied to the wearer's feet by the wrapping panels (e.g., when the wrapping panels wrap around a portion of the footwear article) is distributed. For example, having a wide first portion 132 and a wide third portion 232, as illustrated in FIG. 4A, will distribute the force across a wide area and may reduce hot spots from being applied to the wearer's foot. Continuing further with the example, when the left-shoe wrapping panel 130 is tensioned and presses against the outer surface of the left-shoe upper 108 with the wider first portion 132 and presses against the outer surface of the left-shoe upper 108 with the narrower second portion 134, a larger amount of support may be provided to the medial side of a wearer's left foot, as compared to an amount of support provided to the lateral side of the wearer's left foot. Similar to the left shoe 104, coupling the fourth portion 234 of the right-shoe wrapping panel 230 under tension causes the right-shoe wrapping panel 230 to press against an outer surface of the right-shoe upper 208. And in an asymmetric manner (as compared with the left shoe 104), the illustrated upper 208 of the right shoe 204 has a wider third portion 232 non-releasably coupled to the right-shoe lateral side rather than the right-shoe medial side. As a result, when the right-shoe wrapping panel 230 is tensioned and presses against the outer surface of the right-shoe upper 208 with the wider third portion 232 and presses against the outer surface of the right-shoe upper 208 with the narrower fourth portion 234, a larger amount of support may be provided to the lateral side of a wearer's right foot, as compared to an amount of support provided to the medial side of the wearer's right foot.

In a further aspect, the varied support provided by each of the left shoe 104 and the right shoe 204 is conducive to participating in particular activities. For example, in some sporting events, participants run, sprint, skate, or otherwise race, on a circular or ovular track. In instances in which the participants race in the counterclockwise direction, the turns or curves are to the left, and the participant's right foot is the outside foot. In these instances, particularly when a participant is turning, a larger amount of force is applied to the lateral side of the right shoe 204 and the medial side of the left shoe 104. As such, the pair of shoes depicted in FIG. 4A is configured to apply a greater amount of support on the lateral side of the right shoe 204 and the medial side of the left shoe 104, as explained previously.

Referring now to FIG. 4B, depicted is a left shoe 304 having a left-shoe upper 308 and a left-shoe wrapping panel 330 non-releasably coupled to a medial side of the left shoe 304 at a first portion 332. Opposite of the first portion 332 is a second portion 334, which may be configured to releasably couple with the left-shoe upper 308. The left-shoe wrapping panel 330 further includes a flexible body 336 extending between the first portion 332 and the second portion 334. Additionally, the first portion 332 includes a first leg 338 and a second leg 340. The first leg 338 and the second leg 340 extend towards, and merge at, or before, the second portion 334. In some aspects, the first portion 332 may include more than two legs. In other aspects, the second portion 334 may include a plurality of legs.

Similarly depicted in FIG. 4B is a right shoe 404 having a right-shoe upper 408 and a right-shoe wrapping panel 430 non-releasably coupled to a lateral side of the right shoe 404 at a third portion 432. Opposite of the third portion 432 is a fourth portion 434, which may be configured to releasably couple with the right-shoe upper 408. The right-shoe wrapping panel 430 further includes a flexible body 436 extending between the third portion 432 and the fourth portion 434. Additionally, the third portion 432 includes a third leg 438 and a fourth leg 440. The third leg 438 and the fourth leg 440 extend towards, and merge at or before, the fourth portion 434. In some aspects, the third portion 432 may include more than two legs. In other aspects, the fourth portion 434 may include a plurality of legs.

In some aspects, the first leg 338 may be non-releasably coupled in the forefoot region while the second leg 340 may be non-releasably coupled in the midfoot region. Hence, the first leg 338 may be spaced apart from the second leg 340. The third leg 438 and the fourth leg 440 may be similarly spaced apart and positioned in the forefoot and midfoot regions. The configuration of left-shoe wrapping panel 330 and the right-shoe wrapping panel 430 may provide the first portion 332 and the third portion 432 with a larger effective width than the width of the second portion 334 and the width of the fourth portion 434, respectively. This wider base provides similar advantages to those discussed above with respect to the pair of shoes illustrated in FIG. 4A while including less material for the wrapping panels 330 and 430 than is required for the wrapping panels 130 and 230. Reducing the amount of material needed to form the wrapping panels 330 and 340 may reduce the expense of producing the wrapping panels 330 and 340, may increase breathability provided to the left and right shoes 304 and 404, and may decrease the overall weight of the left and right shoes 304 and 404. The configuration illustrated in FIG. 4B may have more defined load points along the legs of the first and third portions 332 and 432, and as a result, the configuration illustrated in FIG. 4B may have a different fit and feel than a unitary wrapping panel (e.g., left-shoe wrapping panel 130) that has a single load distributed across the unitary wrapping panel.

Turning now to FIG. 4C, depicted is a left shoe 504 having a left-shoe upper 508 and a first left-shoe wrapping panel 530 non-releasably coupled to a medial side of the left shoe 504 at a first portion 532. Opposite of the first portion 532 is a second portion 534, which may be configured to releasably couple with the left-shoe upper 508. The first left-shoe wrapping panel 530 further includes a flexible body 536 extending between the first portion 532 and the second portion 534. Additionally, the left shoe 504 may include a second left-shoe wrapping panel 542 non-releasably coupled to the medial side of the left shoe 504 at a third portion 544. Opposite of the third portion 544 is a fourth portion 546, which may be configured to releasably couple with the left-shoe upper 508. The second left-shoe wrapping panel 542 further includes a flexible body 548 between the third portion 544 and the fourth portion 546.

Similarly depicted in FIG. 4C is a right shoe 604 having a right-shoe upper 608 and a first right-shoe wrapping panel 630 non-releasably coupled to a lateral side of the right shoe 604 at a fifth portion 632. Opposite of the fifth portion 632 is a sixth portion 634, which may be configured to releasably couple with the right-shoe upper 608. The first right-shoe wrapping panel 630 further includes a flexible body 636 extending between the fifth portion 632 and the sixth portion 634. Additionally, the right shoe 604 may include a second right-shoe wrapping panel 642 non-releasably coupled to the lateral side of the right shoe 604 at a seventh portion 644. Opposite of the seventh portion 644 is an eighth portion 646, which may be configured to releasably couple with the right-shoe upper 608. The second right-shoe wrapping panel 642 further includes a flexible body 648 between the seventh portion 644 and the eighth portion 646.

In some aspects, the first portion 532 may be non-releasably coupled in the forefoot region while the third portion 544 may be non-releasably coupled in the midfoot region. Hence, the first portion 532 may be spaced apart from the third portion 544. The fifth portion 632 and the seventh portion 644 may be similarly spaced apart and positioned in the forefoot and midfoot regions. The configuration of first and second left-shoe wrapping panels 530 and 542 and the first and second right-shoe wrapping panels 630 and 642 may provide the first and third portions 532 and 544 and the fifth and seventh portions 632 and 644 with an larger effective width than the effective width of the second and fourth portions 534 and 546 and the effective width of the sixth and eighth portions 634 and 646, respectively. This wider base provides similar advantages to those discussed above with respect to the pair of shoes illustrated in FIG. 3A. Further, having two wrapping panels per shoe allows a more customizable fit than a shoe having only one wrapping panel because a different tension may be applied to each wrapping panel. For example, a greater tension may be applied to the second left-shoe wrapping panel 542 than a tension applied to the first left-shoe wrapping panel 530. As a result, the second left-shoe wrapping panel 542 will press against the outer surface of the left-shoe upper 508 with greater force than does the first left-shoe wrapping panel 530. This may be desirable when a tighter fit is needed around a wearer's midfoot region than the wearer's forefoot region.

Figure 5A:
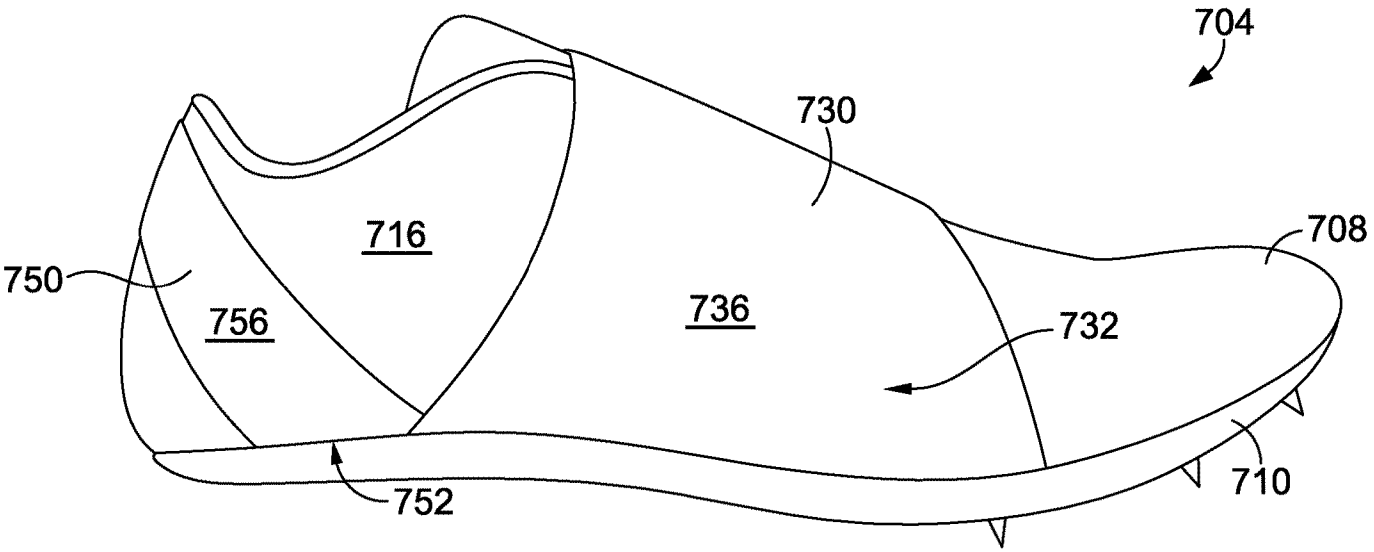
FIG. 5A depicts a medial side of a left shoe in accordance with an aspect hereof.
Figure 5B:
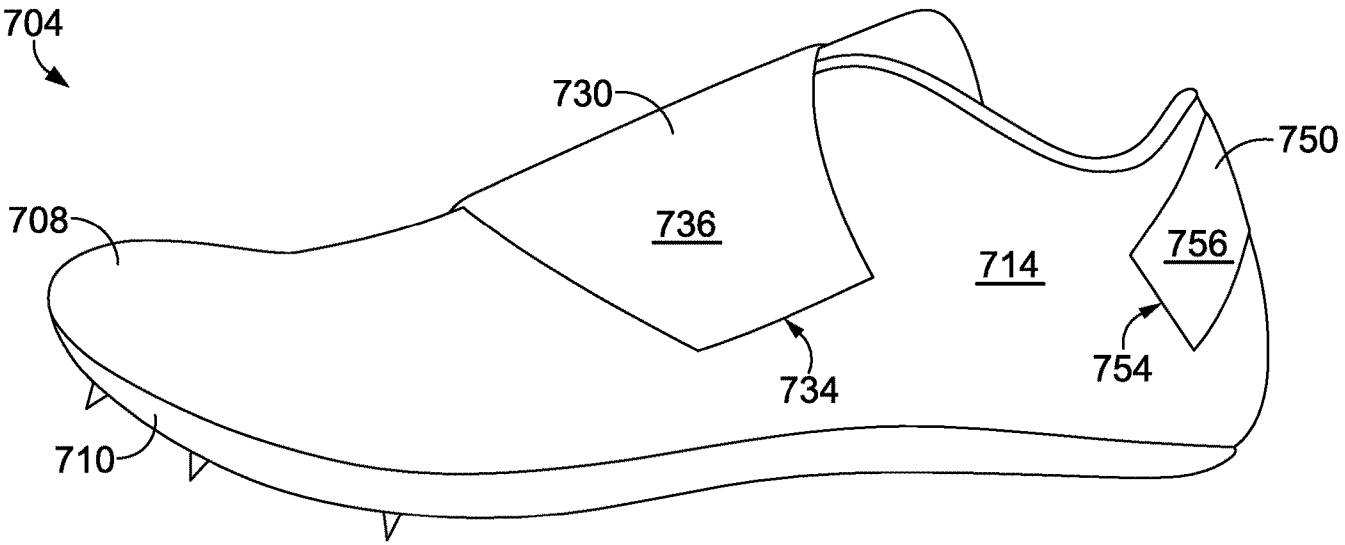
FIG. 5B depicts a lateral side of the left shoe of FIG. 5A in accordance with an aspect hereof.
Figure 6A:
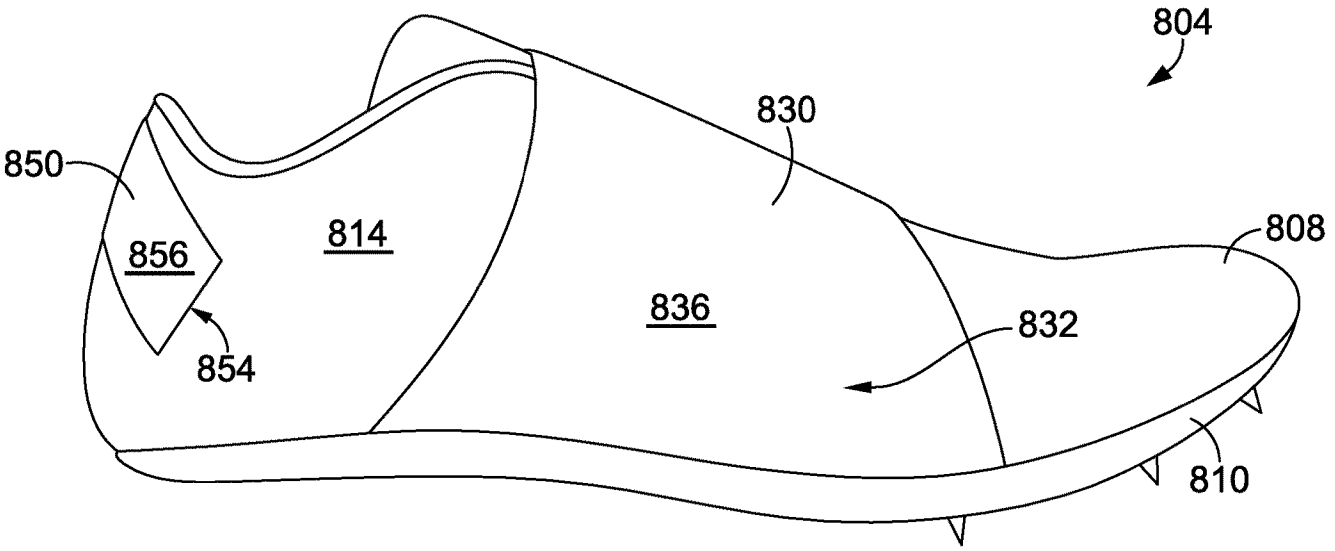
FIG. 6A depicts a lateral side of a right shoe in accordance with an aspect hereof.
Figure 6B:
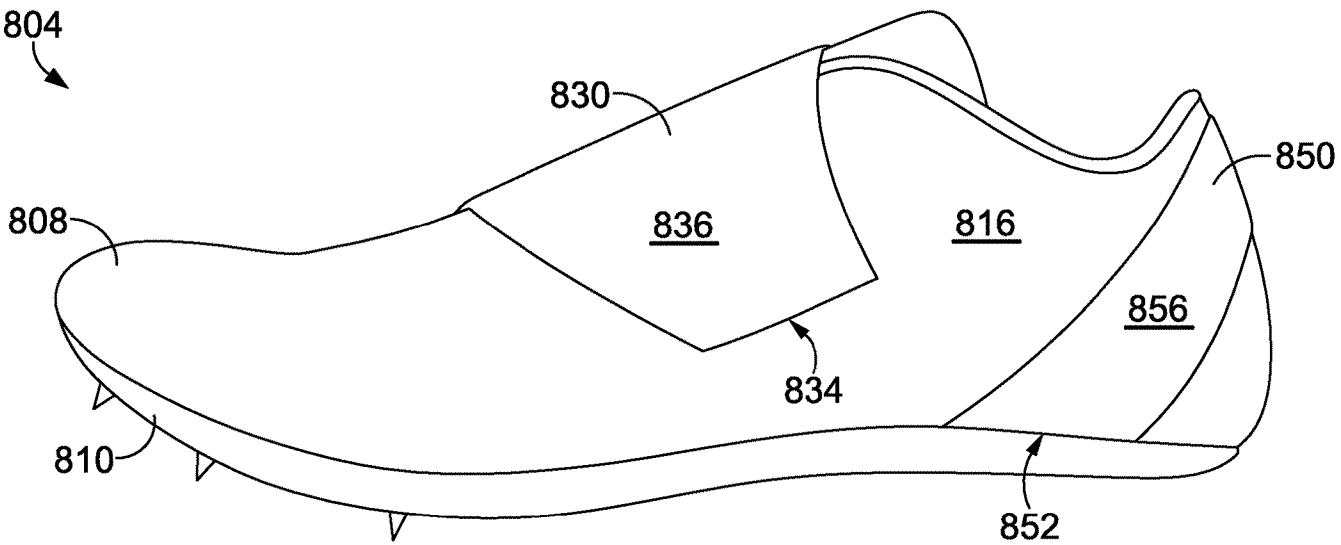
FIG. 6B depicts a medial side of the right shoe of FIG. 6A in accordance with an aspect hereof.

Referring now to FIGS. 5A, 5B, 6A and 6B, additional aspects of this disclosure will be described. FIG. 5A illustrates a medial side view of a left shoe 704, and FIG. 5B illustrates a lateral side view of the left shoe 704. Further, FIG. 6A illustrates a lateral side view of a right shoe 804, and FIG. 6B illustrates a medial side view of the right shoe 804. These views further depict additional features of a pair of shoes that are configured to provide varied amounts of support between the shoes.

The left shoe 704 includes a left-shoe upper 708 affixed to a left-shoe sole 710, a left-shoe wrapping panel 730, and a left-shoe heel strap 750. The left-shoe wrapping panel 730 has, much like the wrapping panels described above, a first portion 732 opposite a second portion 734 and a flexible body 736 between the first portion 732 and the second portion 734. The first portion 732 may be non-releasably coupled to the left-shoe medial side 716. The second portion 734 may releasably couple to the left-shoe lateral side 714. The left-shoe heel strap 750 includes a first end 752 opposite a second end 754 and a flexible body 756 between the first end 752 and the second end 754.

Similarly, the right shoe 804 includes a right-shoe upper 808 affixed to a right-shoe sole 810, a right-shoe wrapping panel 830, and a right-shoe heel strap 850. The right-shoe wrapping panel 830 has, much like the wrapping panels described above, a third portion 832 opposite a fourth portion 834 and a flexible body 836 between the third portion 832 and the fourth portion 834. The third portion 832 may be non-releasably coupled to the right-shoe lateral side 814. The fourth portion 834 may releasably couple to the right-shoe medial side 816. The right-shoe heel strap 850 includes a third end 852 opposite a fourth end 854 and a flexible body 856 between the third end 852 and the fourth end 854.

The first end 752 of the left-shoe heel strap 750 may be non-releasably coupled to the left shoe 704 in the heel region. Likewise, the third end 852 of the right-shoe heel strap 850 may be non-releasably coupled to the right shoe 804 in the heel region. The left-shoe heel strap 750 and the right-shoe heel strap 850 each respectively wrap around at least a portion of the heel region of the left shoe 704 and the right shoe 804. The second end 754 of the left-shoe heel strap 750 may be releasably coupled to the left shoe 704 in the heel region and the fourth end 854 of the right-shoe heel strap 850 may be releasably coupled to the right shoe 804 in the heel region. In other aspects, the second end 754 and the fourth end 854 are respectively releasably coupled to the left shoe 704 and the right shoe 804 in the forefoot region or midfoot region after wrapping around the heel region. When a tension is applied to the left-shoe heel strap 750 and right-shoe heel strap 850, the heel region of the left shoe 704 and right shoe 804, respectively, is pressed against a wearer's foot at the heel region. As a result, the left shoe 704 and the right shoe 804 more securely fit around a wearer's left foot and right foot, respectively.

In the illustrated aspect, the left-shoe heel strap 750 and right-shoe heel strap 850 are not presented asymmetrically between the left shoe 704 and the right shoe 804. Rather, both the left-shoe heel strap 750 and right-shoe heel strap 850 extend from the medial side 716 and 816 to the lateral side 714 and 814. In other aspects, the left-shoe heel strap 750 and right-shoe heel strap 850 may be asymmetric between the pair of shoes similar to the left-shoe wrapping panel 730 and the right-shoe wrapping panel 830. Furthermore, although the illustrated aspects of FIGS. 5A, 5B, 6A, and 6B include a wrapping panel similar to the wrapping panel depicted in FIG. 4A, in other aspects, the wrapping panel that is combined with a heel strap may include a configuration similar to that depicted in FIG. 4B or 4C. Furthermore, although the heel strap is depicted as being non-releasably coupled on the medial side and releasably coupled to the lateral side, in other aspects the heel strap may be non-releasably coupled to the lateral side and releasably coupled to the medial side.

Some aspects of this disclosure have been described with respect to the illustrative examples provided by FIGS. 1-6B. Additional aspects of the disclosure will now be described that may related subject matter included in one or more claims of this application, or one or more related applications, but the claims are not limited to only the subject matter described in the below portions of this description. These additional aspects may include features illustrated by FIGS. 1-6B, features not illustrated by FIGS. 1-6B, and any combination thereof. When describing these additional aspects, reference may or may not be made to elements depicted by FIGS. 1-6B.

One aspect disclosed herein is directed to a pair of shoes comprising a left shoe and a right shoe. The left shoe may have a left-shoe medial side, a left-shoe lateral side, a left-shoe upper, and a left-shoe wrapping panel. The left-shoe wrapping panel may include a first portion that is non-releasably coupled to the left-shoe medial side, a second portion that releasably attaches onto the left-shoe upper, and a flexible body between the first portion and the second portion. The right shoe may have a right-shoe medial side, a right-shoe lateral side, a right-shoe upper, and a right-shoe wrapping panel. The right-shoe wrapping panel may include a third portion that is non-releasably coupled to the right-shoe lateral side, a fourth portion that releasably attaches onto the right-shoe upper, and a flexible body between the third portion and the fourth portion.

The second portion may releasably attach onto the left-shoe lateral side of the left-shoe upper. Similarly, the fourth portion may releasably attach onto the right-shoe medial side of the right-shoe upper. The first portion may be wider than the second portion, such that the left-shoe wrapping panel tapers as it extends from the first portion to the second portion. Likewise, the third portion may be wider than the fourth portion, such that the right-shoe wrapping panel tapers as it extends from the third portion to the fourth portion.

The first portion may include a first arm and a second arm that are spaced apart from one another in the first portion. The first arm and the second arm may merge to form the second portion. The third portion may include a third arm and a fourth arm that are spaced apart from one another in the third portion. The third arm and the fourth arm may merge to form the fourth portion.

A foremost portion of the first portion may be positioned in a left-shoe forefoot and a rearmost portion of the first portion may be positioned in a left-shoe midfoot. A foremost portion of the third portion may be positioned in a right-shoe forefoot and a rearmost portion of the third portion may be positioned in a right-shoe midfoot. The left-shoe upper may comprise a laceless left-shoe upper and the right-shoe upper may comprise a laceless right-shoe upper.

Another aspect disclosed herein is directed to a pair of shoes having a left shoe and a right shoe. The left shoe may have a left-shoe medial side, a left-shoe lateral side, a left-shoe upper, a first left-shoe wrapping panel, and a second left-shoe wrapping panel. The first left-shoe wrapping panel may include a first portion non-releasably coupled to the left-shoe medial side and a second portion releasably coupled to the left-shoe upper. The second left-shoe wrapping panel may include a third portion non-releasably coupled to the left-shoe medial side heelward of the first portion and a fourth portion releasably coupled to the left-shoe upper. The right shoe may have a right-shoe medial side, a right-shoe lateral side, a right-shoe upper, a first right-shoe wrapping panel, and a second right-shoe wrapping panel. The first right-shoe wrapping panel may include a fifth portion non-releasably coupled to the right-shoe lateral side and a sixth portion releasably coupled to the right-shoe upper. The second right-shoe wrapping panel may include a seventh portion non-releasably coupled to the right-shoe lateral side heelward of the fifth portion and an eighth portion releasably coupled to the right-shoe upper.

The left shoe may also have a left-shoe heel region, a left-shoe forefoot region, and a left-shoe mid-foot region. The right shoe may also have a right-shoe heel region, a right-shoe forefoot region, and a right-shoe mid-foot region. The first portion of the first left-shoe wrapping panel may be non-releasably attached in the left-shoe mid-foot region. The fifth portion of the first right-shoe wrapping panel may be non-releasably attached in the right-shoe mid-foot region.

In some aspects, the third portion may non-releasably attach to the left-shoe medial side in the left-shoe forefoot region and the seventh portion may non-releasably attach to the right-shoe lateral side in the right-shoe forefoot region. In other aspects, the third portion may non-releasably attach to the left-shoe medial side in the left-shoe mid-foot region and the seventh portion may non-releasably attach to the right-shoe lateral side in the right-shoe mid-foot region. In still other aspects, the third portion may non-releasably attach to the left-shoe medial side in the left-shoe heel region and the seventh portion may non-releasably attach to the right-shoe lateral side in the right-shoe heel region.

The first portion and the third portion may be spaced a first distance apart from one another when non-releasably coupled. The second portion and the fourth portion may be spaced a second distance apart from one another when releasably coupled. The first distance may be larger than the second distance. The fifth portion and the seventh portion may be spaced a third distance apart from one another when non-releasably coupled. The sixth portion and the eighth portion may be spaced a fourth distance apart from one another when releasably coupled. The third distance may be larger than the fourth distance. As such, the first portion and the third portion may be spaced farther from one another than the second portion and the fourth portion are spaced from one another when releasably coupled to the upper, and the fifth portion and the seventh portion may be spaced farther from one another than the sixth portion and the eighth portion are spaced from one another when releasably coupled to the upper.

Each of the second and fourth portions may be releasably coupled in a mid-foot portion of the left-shoe lateral side. Similarly, each of the sixth and eighth portions may be releasably coupled in a mid-foot portion of the right-shoe medial side. Each of the first and second left-shoe wrapping panels may comprise a first and second left-shoe strap, respectively. Each of the first and second right-shoe wrapping panels may comprise a first and second right-shoe strap, respectively.

Yet another aspect disclosed herein is directed to a pair of shoes comprising a left shoe and a right shoe. The left shoe may have a left-shoe medial side, a left-shoe lateral side, a left-shoe heel region, and a left-shoe mid-foot region. The left shoe may also have a left-shoe wrapping panel that is non-releasably coupled to the left-shoe medial side in the left-shoe mid-foot region and that releasably attaches to another portion of the left shoe. The left shoe may also have a left-shoe heel strap having a first end that is non-releasably coupled in the left-shoe heel region, a second end that releasably attaches to the left shoe, and a flexible body that wraps at least partially around the left-shoe heel region. The right shoe may have a right-shoe medial side, a right-shoe lateral side, a right-shoe heel region, and a left-shoe mid-foot region. The right shoe may also have a right-shoe wrapping panel that is non-releasably coupled to the right-shoe lateral side in the right-shoe mid-foot region and that releasably attaches to another portion of the right shoe. The right shoe may also have a right-shoe heel strap having a first end that is non-releasably coupled in the right-shoe heel region, a second end that releasably attaches to the right shoe, and a flexible body that wraps at least partially around the right-shoe heel region.

The first end of the left-shoe heel strap may non-releasably attach on the left-shoe medial side and the second end of left-shoe heel strap may releasably attach on the left-shoe lateral side. The first end of the right-shoe heel strap may non-releasably attach on the right-shoe medial side and the second end of right-shoe heel strap may releasably attach on the right-shoe lateral side. The first end of the left-shoe heel strap may non-releasably attach on the left-shoe lateral side and the second end of left-shoe heel strap may releasably attach on the left-shoe medial side. The first end of the right-shoe heel strap may non-releasably attach on the right-shoe lateral side and the second end of right-shoe heel strap may releasably attach on the right-shoe medial side.

The left shoe and the right shoe both may include a respective laceless upper. The second end of the left-shoe heel strap may releasably attach to the left shoe in the left-shoe heel region and the second end of the right-shoe heel strap may releasably attach to the right shoe in the right-shoe heel region. The second end of the left-shoe heel strap may releasably attach to the left shoe in the left-shoe mid-foot region and the second end of the right-shoe heel strap may releasably attach to the right shoe in the right-shoe mid-foot region.

From the foregoing, it will be seen that this subject matter is adapted to attain ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made of the subject matter without departing from the scope thereof, it is to be understood that all matter herein set forth or shown in the accompanying drawings is to be interpreted as illustrative and not in a limiting sense.

The invention claimed is:

1. A pair of shoes comprising:

a left shoe having a left-shoe medial side, a left-shoe lateral side, a left-shoe upper attached to a left-shoe sole along a left-shoe biteline, and a left-shoe wrapping panel, wherein the left-shoe wrapping panel includes a first portion that is non-releasably coupled to the left-shoe medial side at the left-shoe biteline, a second portion forming a terminal end of the left-shoe wrapping panel that releasably attaches onto an area of the left-shoe upper positioned opposite the first portion, and a flexible body between the first portion and the second portion; and a right shoe having a right-shoe medial side, a right-shoe lateral side, a right-shoe upper attached to a right-shoe sole along a right-shoe biteline, and a right-shoe wrapping panel, wherein the right-shoe wrapping panel includes a third portion that is non-releasably coupled to the right-shoe lateral side at the right-shoe biteline, a fourth portion forming a terminal end of the right-shoe wrapping panel that releasably attaches onto an area of the right-shoe upper positioned opposite the third portion, and a flexible body between the third portion and the fourth portion, wherein a foremost portion of the first portion of the left-shoe wrapping panel is non-releasably coupled in a forefoot region of the left-shoe upper and a rearmost portion of the first portion of the left-shoe wrapping panel is non-releasably coupled in a midfoot region of the left-shoe upper, a width of the flexible body between the first portion and the second portion tapering heelward in a direction normal to the direction of extension, and the second portion releasably attaching in the midfoot region opposite the first portion, wherein a foremost portion of the third portion of the right-shoe wrapping panel is non-releasably coupled in a forefoot region of the right-shoe upper, and a rearmost portion of the third portion of the right-shoe wrapping panel is non-releasably coupled in a midfoot region of the right-shoe upper, a width of the flexible body between the third portion and the fourth portion tapering heelward in a direction normal to the direction of extension, and the fourth portion releasably attaching in the midfoot region opposite the third portion.

2. The pair of shoes of claim 1, wherein the second portion releasably attaches onto the left-shoe lateral side of the left-shoe upper, and wherein the fourth portion releasably attaches onto the right-shoe medial side of the right-shoe upper.

3. The pair of shoes of claim 1, wherein the first portion includes a first arm and a second arm that are spaced apart from one another in the first portion and that merge to form the second portion, and wherein the third portion includes a third arm and a fourth arm that are spaced apart from one another in the third portion and that merge to form the fourth portion.

4. The pair of shoes of claim 1, wherein the first portion is positioned in a left-shoe midfoot, and wherein the third portion is positioned in a right-shoe midfoot.

5. The pair of shoes of claim 1, wherein the left-shoe upper comprises a laceless left-shoe upper and the right-shoe upper comprises a laceless right-shoe upper.

6. A pair of shoes comprising:

a left shoe having a left-shoe medial side, a left-shoe lateral side, a left-shoe upper attached to a left-shoe sole along a left-shoe biteline, a first left-shoe wrapping panel, and a second left-shoe wrapping panel, wherein the first left-shoe wrapping panel includes a first portion non-releasably coupled at the left-shoe biteline to the left-shoe medial side in a forefoot region and a second portion forming a first terminal end of the first left-shoe wrapping panel that is releasably coupled to a first area of the left-shoe upper positioned opposite the first portion in a midfoot region, wherein the first left-shoe wrapping panel tapers continuously from the first portion to the second portion, and wherein the second left-shoe wrapping panel includes a third portion non-releasably coupled at the left-shoe biteline to the left-shoe medial side heelward of the first portion and a fourth portion forming a second terminal end of the second left-shoe wrapping panel that is releasably coupled to a second area of the left-shoe upper positioned opposite the third portion; and a right shoe having a right-shoe medial side, a right-shoe lateral side, a right-shoe upper attached to a right-shoe sole along a right-shoe biteline, a first right-shoe wrapping panel, and a second right-shoe wrapping panel, wherein the first right-shoe wrapping panel includes a fifth portion non-releasably coupled at the right-shoe biteline to the right-shoe lateral side in a forefoot region and a sixth portion forming a third terminal end of the first right-shoe wrapping panel that is releasably coupled to a third area of the right-shoe upper positioned opposite the fifth portion in a midfoot region, wherein the first right-shoe wrapping panel tapers continuously from the fifth portion to the sixth portion, and wherein the second right-shoe wrapping panel includes a seventh portion non-releasably coupled at the right-shoe biteline to the right-shoe lateral side heelward of the fifth portion and an eighth portion forming a fourth terminal end of the second right-shoe wrapping panel that is releasably coupled to a fourth area of the right-shoe upper positioned opposite the seventh portion.

7. The pair of shoes of claim 6 further comprising:

the left shoe having a left-shoe heel region, a left-shoe forefoot region, and a left-shoe mid-foot region, wherein the first portion of the first left-shoe wrapping panel is non-releasably attached at the left-shoe biteline in the left-shoe mid-foot region; and the right shoe having a right-shoe heel region, a right-shoe forefoot region, and a right-shoe mid-foot region, wherein the fifth portion of the first right-shoe wrapping panel is non-releasably attached at the right-shoe biteline in the right-shoe mid-foot region.

8. The pair of shoes of claim 7, wherein the third portion non-releasably attaches to the left-shoe medial side in the left-shoe mid-foot region and the seventh portion non-releasably attaches to the right-shoe lateral side in the right-shoe mid-foot region.

9. The pair of shoes of claim 7, wherein the third portion non-releasably attaches to the left-shoe medial side in the left-shoe heel region and the seventh portion non-releasably attaches to the right-shoe lateral side in the right-shoe heel region.

10. The pair of shoes of claim 6, wherein the first portion and the third portion are spaced farther from one another than the second portion and the fourth portion are spaced from one another when releasably coupled; and wherein the fifth portion and the seventh portion are spaced farther from one another than the sixth portion and the eighth portion are spaced from one another when releasably coupled.

11. The pair of shoes of claim 10, wherein each of the second and fourth portions are releasably coupled in a mid-foot portion of the left-shoe lateral side, and wherein each of the sixth and eighth portions are releasably coupled in a mid-foot portion of the right-shoe medial side.

12. The pair of shoes of claim 6, wherein each of the first and second left-shoe wrapping panels comprises a first and second left-shoe strap, respectively, and wherein each of the first and second right-shoe wrapping panels comprises a first and second right-shoe strap, respectively.

13. The pair of shoes of claim 6, wherein a spacing between the first portion and the third portion at the left-shoe biteline is greater than a spacing between the first and the second terminal ends, and wherein a spacing between the fifth portion and the seventh portion at the right-shoe biteline is greater than a spacing between the third and the fourth terminal ends.

14. A pair of shoes comprising:

a left shoe comprising a left-shoe medial side, a left-shoe lateral side, a left-shoe heel region, and a left-shoe mid-foot region;

a left-shoe wrapping panel that is non-releasably coupled to the left-shoe medial side in the left-shoe mid-foot region and, the left-shoe wrapping panel including a terminal end that releasably attaches to another area of the left shoe positioned opposite the left-shoe medial side; and a left-shoe heel strap having a first end that is non-releasably coupled at a left-shoe biteline in the left-shoe heel region, a second end that releasably attaches to the left shoe, and a flexible body that wraps at least partially around the left-shoe heel region; and a right shoe comprising a right-shoe medial side, a right-shoe lateral side, a right-shoe heel region, and a right-shoe mid-foot region;

a right-shoe wrapping panel that is non-releasably coupled to the right-shoe lateral side at a right-shoe biteline in the right-shoe mid-foot region and, the right-shoe wrapping panel including a terminal end that releasably attaches to another area of the right shoe positioned opposite the right-shoe lateral side; and a right-shoe heel strap having a first end that is non-releasably coupled in the right-shoe heel region, a second end that releasably attaches to the right shoe, and a flexible body that wraps at least partially around the right-shoe heel region.

15. The pair of shoes of claim 14, wherein the first end of the left-shoe heel strap non-releasably attaches on the left-shoe medial side and the second end of left-shoe heel strap releasably attaches on the left-shoe lateral side; and wherein the first end of the right-shoe heel strap non-releasably attaches on the right-shoe medial side and the second end of right-shoe heel strap releasably attaches on the right-shoe lateral side.

16. The pair of shoes of claim 14, wherein the first end of the left-shoe heel strap non-releasably attaches on the left-shoe lateral side and the second end of left-shoe heel strap releasably attaches on the left-shoe medial side; and wherein the first end of the right-shoe heel strap non-releasably attaches on the right-shoe lateral side and the second end of right-shoe heel strap releasably attaches on the right-shoe medial side.

17. The pair of shoes of claim 14, wherein the left shoe and the right shoe both include a respective laceless upper.

18. The pair of shoes of claim 14, wherein the second end of the left-shoe heel strap releasably attaches to the left shoe in the left-shoe heel region and the second end of the right-shoe heel strap releasably attaches to the right shoe in the right-shoe heel region.

19. The pair of shoes of claim 14, wherein the second end of the left-shoe heel strap releasably attaches to the left shoe in the left-shoe mid-foot region and the second end of the right-shoe heel strap releasably attaches to the right shoe in the right-shoe mid-foot region.

* * * * *